US012521786B2

(12) United States Patent
Koppensteiner

(10) Patent No.: US 12,521,786 B2
(45) Date of Patent: Jan. 13, 2026

(54) METHOD FOR MACHINING A METAL CAST STRAND OF ROUND CROSS-SECTION BY REDUCING THE CROSS-SECTION IN THE FINAL SOLIDIFICATION REGION

(71) Applicant: GFM GmbH, Steyr (AT)

(72) Inventor: Robert Koppensteiner, Steyr (AT)

( * ) Notice: Subject to any disclaimer, the term of this patent is extended or adjusted under 35 U.S.C. 154(b) by 260 days.

(21) Appl. No.: 17/761,232

(22) PCT Filed: Dec. 22, 2020

(86) PCT No.: PCT/AT2020/060485
§ 371 (c)(1),
(2) Date: Mar. 17, 2022

(87) PCT Pub. No.: WO2021/127717
PCT Pub. Date: Jul. 1, 2021

(65) Prior Publication Data

US 2022/0362833 A1 Nov. 17, 2022

(30) Foreign Application Priority Data

Dec. 23, 2019 (AT) ..... A 51154/2019

(51) Int. Cl.
*B21J 5/00* (2006.01)
*B21J 1/02* (2006.01)
(Continued)

(52) U.S. Cl.
CPC . *B21J 5/00* (2013.01); *B21J 1/02* (2013.01); *B21J 5/002* (2013.01); *B21J 7/14* (2013.01); *B22D 11/1206* (2013.01)

(58) Field of Classification Search
CPC ..... B21J 7/14; B21J 7/145; B21J 5/002; B21J 5/004; B21J 1/02
(Continued)

(56) References Cited

U.S. PATENT DOCUMENTS 3,175,387 A * 3/1965 Wichmann ..... B21J 7/14 100/232
3,654,789 A 4/1972 Brauer
(Continued)

FOREIGN PATENT DOCUMENTS

DE 27 33 276 A1 2/1978
DE 4002854 C1 * 10/1991
(Continued)

OTHER PUBLICATIONS

M. Kawaberi, et al., "Development of high quality bar and rod by applying continuous forging at continuous caster," XP 000267961, 1075 Revue de Metallurgie 89, Feb. 1992, No. 2, Paris, France.

*Primary Examiner* — Christopher L Templeton
*Assistant Examiner* — P Derek Pressley
(74) *Attorney, Agent, or Firm* — Tiajoloff & Kelly LLP

(57) ABSTRACT

The system described herein relates to working a metal casting strand that is round in cross-section, by reducing the cross-section in the final solidification region with the aid of at least three forming tools which are distributed around the circumference and act simultaneously on the casting strand. In order to provide advantageous working conditions, the casting strand is formed by forging tools constituting the forming tools in a longitudinal portion for each forming stroke, which portion corresponds to at least a fourth of the strand diameter before the reduction in cross-section. The forging tools are rotated by an angle step about the axis of the casting strand 1 between the forming strokes.

9 Claims, 3 Drawing Sheets

(51) Int. Cl.
*B21J 7/14* (2006.01)
*B22D 11/12* (2006.01)

(58) Field of Classification Search
USPC ..... 72/76
See application file for complete search history.

(56) References Cited

U.S. PATENT DOCUMENTS

| | | | | |
|---|---|---|---|---|
| 3,812,699 | A * | 5/1974 | Koost | B21J 7/16 72/76 |
| 4,493,363 | A | 1/1985 | Fredriksson et al. | |
| 4,766,808 | A | 8/1988 | Schröck | |
| 5,992,502 | A | 11/1999 | Blaimschein et al. | |

FOREIGN PATENT DOCUMENTS

| | | | | |
|---|---|---|---|---|
| DE | 4206260 | A1 * | 9/1993 | B21J 7/14 |
| DE | 197 00 486 | A1 | 8/1997 | |
| DE | 101 44 234 | A1 | 3/2003 | |
| DE | 10 2011 012 508 | A1 | 8/2012 | |
| EP | 0 239 875 | A2 | 10/1987 | |
| EP | 0345734 | A2 * | 12/1989 | |
| EP | 1166917 | A2 * | 1/2002 | B21J 5/00 |
| EP | 1291099 | A2 * | 3/2003 | B22D 11/1206 |
| WO | WO-2018069854 | A1 * | 4/2018 | B21B 1/46 |
| WO | WO-2019084430 | A1 * | 5/2019 | B24B 29/00 |

* cited by examiner

METHOD FOR MACHINING A METAL CAST STRAND OF ROUND CROSS-SECTION BY REDUCING THE CROSS-SECTION IN THE FINAL SOLIDIFICATION REGION

TECHNICAL FIELD

The system described herein relates to machining a metal cast strand of round cross-section.

BACKGROUND OF THE INVENTION

In the region of final solidification of metal cast strands of round cross-section, the core temperature drops much more quickly than the surface temperature of the cast strand, which leads to different thermal contractions and consequently to segregations and to a porosity of the core. In order to counteract the segregations and the porosity phenomena, a reduction in cross-section, known as a soft reduction, is carried out in the final solidification region. For this, it is known (DE 101 44 234 A1, WO 2018/069854 A1) to use at least three forming tools in the form of rolls, which are distributed around the circumference of the strand and which subject the cast strand to a soft reduction, but with only moderate success since the depth effect of the reduction in cross-section is limited by the use of rolls and larger reductions in cross-section increase the risk of crack formation.

To avoid run-in difficulties when rolling billets obtained by sawing through a cast strand, it has been proposed (DE 10 2011 012 508 A1) to provide the cast strand with a chamfer in the region of the subsequent separating cuts by means of forging tools arranged opposite one another in pairs, namely before the core of the cast strand has fully solidified. Because the material is partially liquid, the forging forces can be kept small. In addition, the rate of cooling can be increased in the forming region. However, no significant effect on core porosity is to be expected.

In order to be able to avoid segregations during the continuous casting of steel and of metal alloys, it is known (DE 27 33 276 A1) to plastically deform the cast strand during the solidification, namely by rolling, so that the cross-sectional area of the strand is reduced in a manner corresponding to the solidification shrinkage, as a result of which it is possible to prevent any upward or downward melt displacement in the solidifying strand. However, the core structure remains substantially unaffected by this.

To improve the structure, it is known (DE 197 00 486 A1) to subject a preliminary product that has been produced by continuous casting to a forging process. However, this requires a fully solidified preliminary product.

In order to ensure advantageous pressing conditions in the case of radial presses for workpieces of round cross-section, it is known (EP 0 239 875 A2) to support the press jaws on wedge surfaces, inclined in opposite directions in the axial direction, of two control bodies which are axially movable relative to one another, so that, when pressure is applied in opposite directions by the two control bodies, the press jaws, which together with the control bodies form a wedge gear, are radially displaced and execute a forming stroke. When the control bodies are subsequently moved apart, the press jaws guided along the wedge surfaces are retracted radially back into the starting position. Due to the relatively small axial length in relation to the pressing stroke, these radial presses are particularly suitable for pressing hose fittings onto hydraulic hoses.

SUMMARY OF THE INVENTION

It is desirable to machine round cast strands by means of a soft reduction in such a way that core porosities can be largely avoided, without exposing the cast strand to a risk of cracking.

The system described herein solves the stated problem in that, with each forming stroke, the cast strand is formed by forging tools, which form the forming tools, in a longitudinal portion that corresponds to at least one quarter of the strand diameter prior to the reduction in cross-section, and in that, between the forming strokes, the forging tools are rotated through one angle step about the axis of the cast strand.

The use of forming tools in the form of forging tools firstly fulfils the requirement of improving the depth effect of the plastic deformations of the cast strand in the final solidification region, namely due to the action of the forging tools over an appropriate longitudinal portion of the cast strand, which is made possible by the axial length of extension of the forging tools. If, for each forming stroke, this longitudinal forming portion is selected to correspond to one quarter of the strand diameter prior to the reduction in cross-section, a quality-improving effect on the residual porosity of the cast strand is already noticeable. This effect increases with the axial length of extension of tool contact, so that the longitudinal portion of the strand covered by the forging tools per forming stroke is preferably in a range between 0.6 times the strand diameter and the strand diameter.

However, the depth effect of the plastic strand deformation, which is improved by the axial length of extension of the forging tools, is not sufficient to largely prevent, in particular, the core porosity of the cast strand, even if it is possible to compress, by way of the forming strokes of the forging tools, the cavities formed during the solidification of the strand. However, by rotating the forging tools about the strand axis relative to the cast strand between the forming strokes, this is surprisingly achieved without having to perform a larger reduction in cross-section, which is associated with a risk of cracking. The effect linked to the stepwise rotation of the forging tools about the strand axis is explained by the fact that the core regions containing the cavities are repeatedly exposed to shear stresses and compressive stresses in different directions due to the helical machining of the strand, so that the cavities responsible for pore formation can be reduced in stages until they disappear.

However, the rotation steps of the forging tools between the forming strokes is not selected to be too small because otherwise the effect of the forces acting on the volume units from different directions will be lost. The rotation steps between individual forming strokes that are advantageous for a respective cast strand can be determined relatively easily through simulation calculations or practical experiments and can be predefined in particular as a function of the casting speed, the number of forging tools, the reduction in cross-section, the frequency of the forming strokes and the material properties.

If it is assumed that the cast strand is to be machined around its entire circumference in a longitudinal portion of the cast strand corresponding to the contact length of the forging tools, then, for a minimum machining over a circumferential range of 360° during a strand feed corresponding to the contact length of the forging tools, this results in a rotation step between the individual forming strokes that depends on the strand feed between the forming strokes and the contact length of the forging tools because, following a feeding of the cast strand corresponding to the contact length of the forging tools, strand machining is carried out over a circumferential portion associated with the individual tools. This means that the circumferential portion associated with the individual forging tools is divided according to the number of feed steps of the strand up to a total feed according to the contact length of the forging tools, in order to determine the angle that is to be predefined as the lower limit for 360° cast strand machining. Therefore, for the smallest rotation step angle, the pitch of the helical machining course results from the multiple of the contact length of the forging tools corresponding to the number of forging tools. Therefore, for a strand feed of 54 mm between the forming strokes and a contact length of the forging tools of 350 mm, the smallest rotation step angle between two forming strokes is calculated at 18° when using three forging tools, but at 14° when using four forging tools.

Since the depth effect of the forging tools is important for suppressing a core porosity, care must be taken to ensure that the cross-sectional shape of the cast strand is maintained as far as possible during the soft reduction. Therefore, during the forming strokes, the cast strand is sufficiently supported centrically by the forging tools distributed around the strand circumference. This is advantageous if, with each forming stroke, the cast strand is formed by the forging tools in a circumferential region of at least 20° divided among the individual forging tools and relating to the mean width of the contact areas between the forging tool and the cast strand, that is to say if the forging tools act simultaneously on the cast strand over a circumferential portion extending over at least 20° and divided among the forging tools.

For a soft reduction, the cast strand is machined in the final solidification region, namely advantageously on both sides of the sump tip. If the cast strand is machined by the forging tools in a longitudinal portion that extends from a cross-section of the cast strand having a solid phase content of 80% to a cross-section in which the temperature difference between core and surface is 300 K, the conditions for a soft reduction according to the system described herein by means of forging tools are generally well met. The cross-section of the cast strand should be reduced by at least 8% by the forging tools in order that a noticeable effect on the core porosity can be exerted.

In order to carry out the method for machining a metal cast strand of round cross-section by reducing the cross-section in the final solidification region, a device having at least three forging tools which are arranged in a rotationally symmetrical manner in relation to a forging axis, are mounted in the frame of a forging press, and are connected to a drive for forming strokes radial to the forging axis can be taken as the starting point. If, in such a device, the frame is mounted in a housing in such a way as to be rotatable about the forging axis and is connected to a stepper drive for rotation through in each case one angle step between the forming strokes, all the conditions for carrying out the method are met. The radial forming strokes can be carried out by means of the forging tools, wherein the stepwise soft reduction of the cast strand along a helical line can be ensured by rotating the frame holding the forging tools about the forging axis between the forming strokes.

Particularly simple design conditions arise in this context if the frame has two adjusting discs which are axially displaceable relative to one another and which form wedge surfaces, sloping downwards and outwards in the axial direction, of a wedge gear for the radial stroke drive. The forging tools, which are supported with corresponding matching surfaces on the wedge surfaces in a slidable manner, are thus radially displaced when the adjusting discs are moved in opposite directions.

Although a synchronous movement of the forging tools with the cast strand during forging contact is not mandatory on account of the usual frequencies of the forming strokes in conjunction with the relatively low casting speed, the forging tools may be moved with the cast strand during the forming strokes in order to be returned to the starting position during the idle stroke. For this purpose, the frame holding the forging tools may be mounted within the housing in an axially displaceable manner and may be connected to an axial actuator. If the housing of the forging press is itself displaceable along a guide of the cast strand, the forging press can be oriented opposite the final solidification region of the cast strand, whereby a shift in the final solidification region due to changing casting parameters can also be taken into account.

BRIEF DESCRIPTION OF THE DRAWINGS

The subject matter of the system described herein is shown by way of example in the drawing, in which.

DESCRIPTION OF VARIOUS EMBODIMENTS

Figure 1:
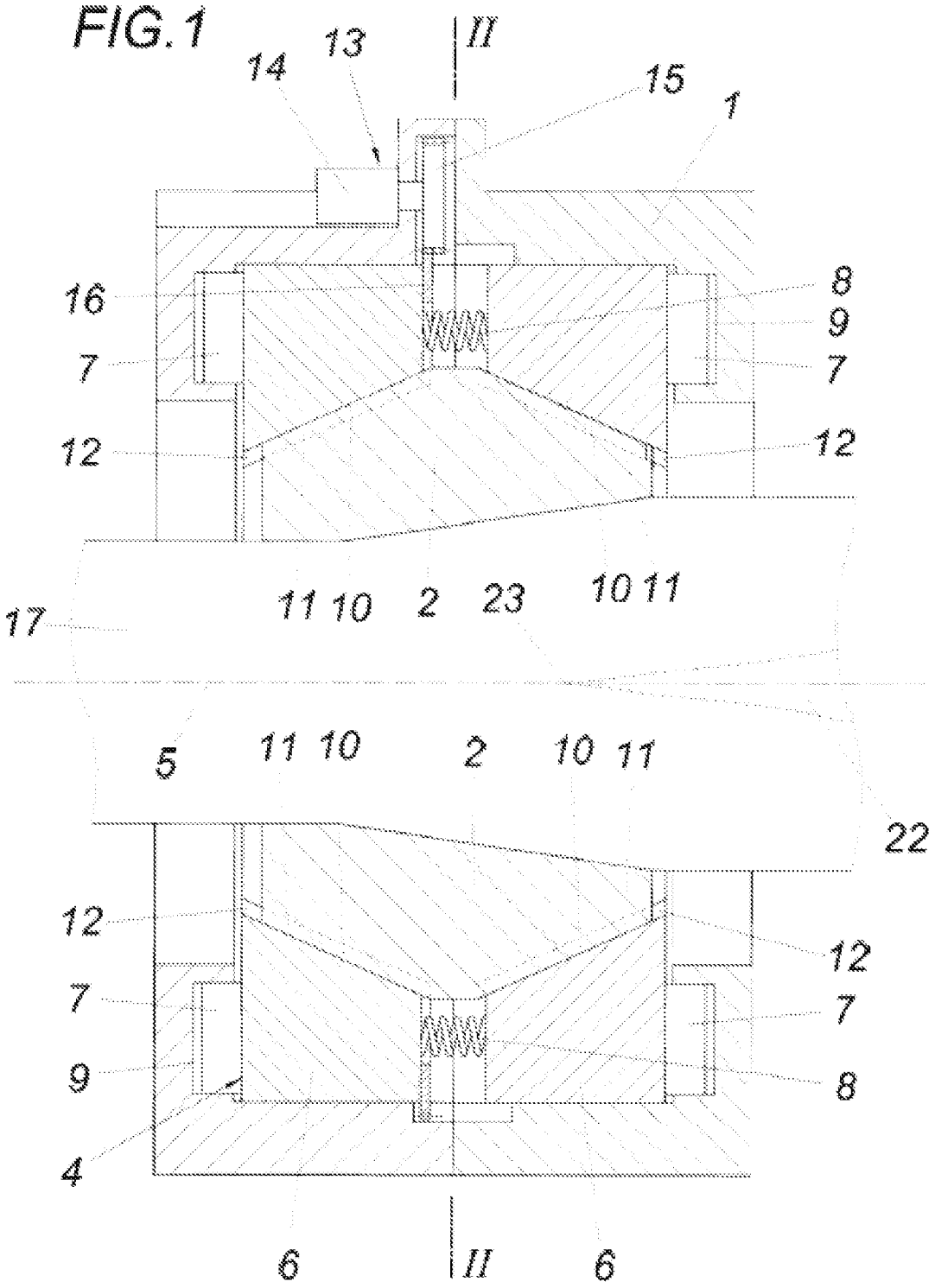
FIG. 1 shows, in a schematic longitudinal section, a forging press according to the system described herein for machining a round, metal cast strand.
Figure 2:
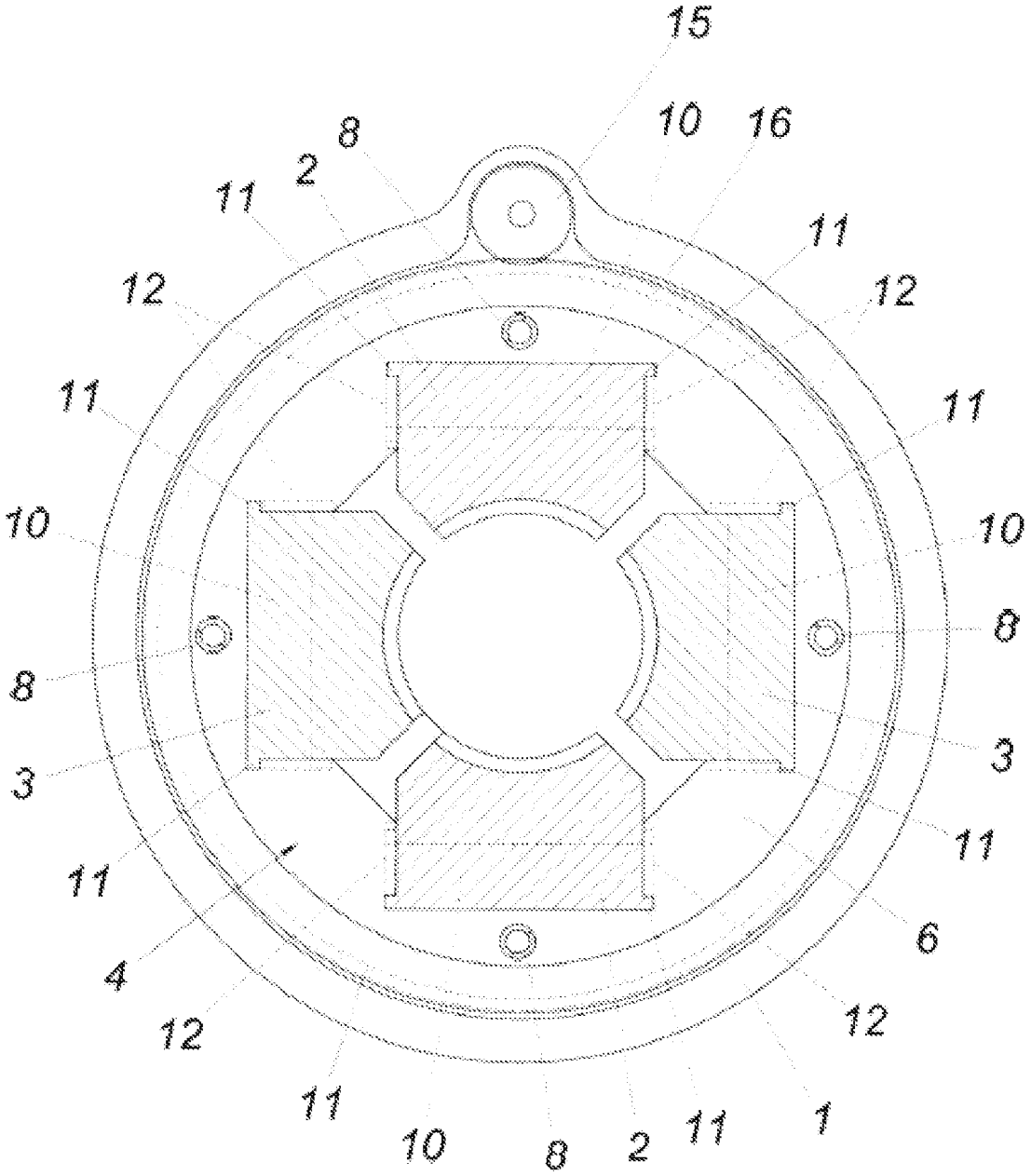
FIG. 2 shows this device in a cross-section along the line II-II of FIG. 1 on a smaller scale.

The forging press shown in FIGS. 1 and 2 has a housing 1, in which a frame 4 is mounted in such a way as to be rotatable about a forging axis 5, said frame holding forging tools 2, 3 located opposite one another in pairs. Said frame 4 is formed by two adjusting discs 6, which are mounted in the housing 1 in such a way as to be displaceable in the axial direction and can be acted upon by pistons 7 counter to the force of return springs 8, which are supported between the two adjusting discs 6. The pistons 7 engage in annular chambers 9, which are formed in the housing 1 and to which a hydraulic medium can be supplied.

The two adjusting discs 6 are provided with wedge surfaces 10 inclined in opposite directions, on which the forging tools 2, 3 bear with corresponding mating surfaces in a sliding manner, so that corresponding wedge gears are formed between the adjusting discs 6 and the forging tools. In the edge region of the wedge surfaces 10, the forging tools 2, 3 are provided with guide strips 11, which engage in guide grooves 12 of the adjusting discs 6. When a compressive force is applied to the adjusting discs 6 by way of the pistons 7, said adjusting discs are moved towards one another, which results in a sliding movement of the forging tools 2, 3 relative to the wedge surfaces 10 of the adjusting discs 6, with the effect that the forging tools 2, 3 execute a radial forming stroke. When the pressure of the pistons 7 is removed, the adjusting discs 6 are moved back to the starting position by the return springs 8, with the forging tools 2, 3 guided along the wedge surfaces 10 executing an idle stroke.

Between the forming strokes of the wedge gear, the frame 4, which comprises the two adjusting discs 6, can be rotated through one rotation step by means of a stepper drive 13. In the exemplary embodiment shown, the stepper drive 13 comprises a pinion 15, which is driven by a stepper motor 14 and meshes with a ring gear 16 connected to one of the two adjusting discs 6. However, any other rotational stepper drive is also possible. The cast strand 17 can thus be reduced in cross-section by the forging tools 2, 3 located opposite one another in pairs, with the frame 4 being rotated through one rotation step between the forming strokes in order to ensure a stepwise machining of the cast strand 17 along a helical course around the forging axis 5.

Figure 3:
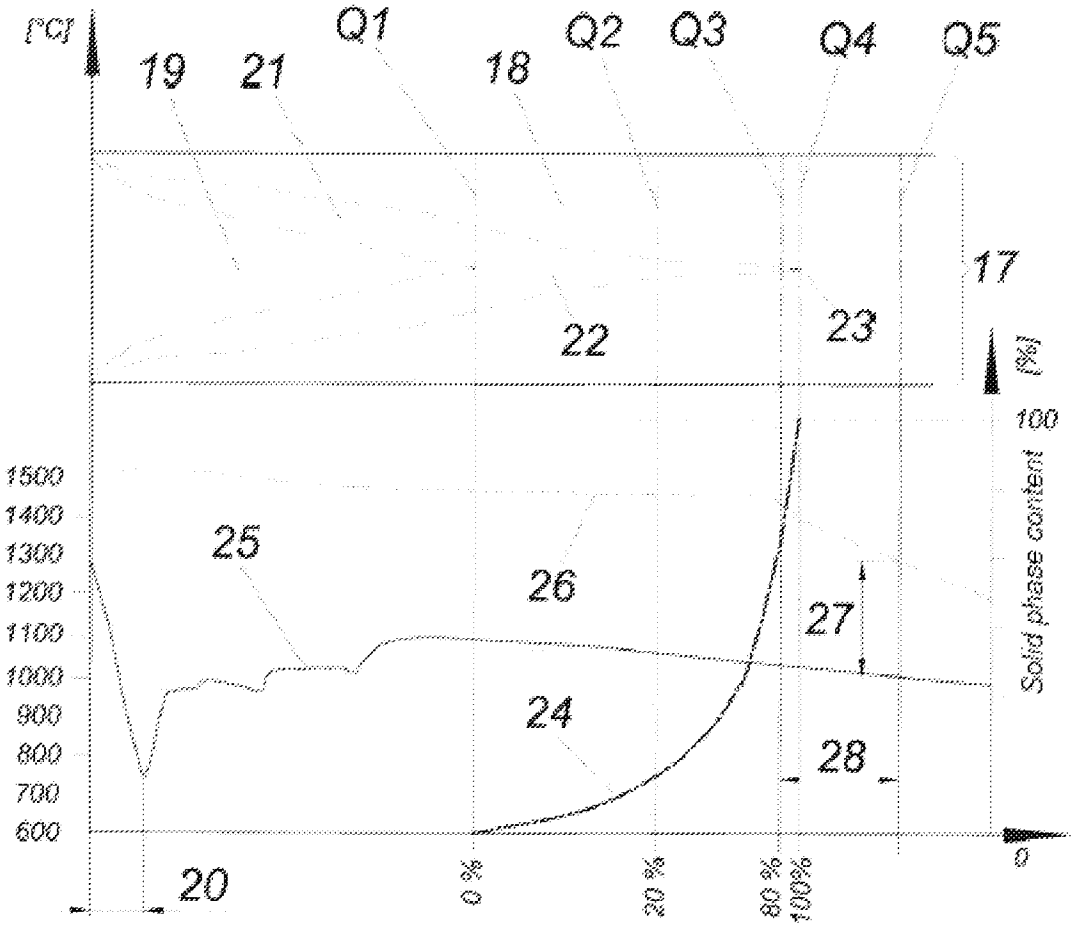
FIG. 3 shows a cast strand with a schematic distribution of the liquid and solid phase over the strand length up to complete solidification as well as in the core and surface region.

As can be seen from FIG. 3, the cast strand 17 is cooled during the casting, with the effect that a solid shell 18 forms around the liquid core 19. The casting region 20 is followed by a cooling region, in which cooling fluid is sprayed onto the cast strand 17. As a result, a gradual solidification of the cast strand 17 occurs from the outside towards the inside, with a mixed phase 21 being formed between the liquid phase 19 and the solid shell 18, said mixed phase running out into a sump 22, the tip 23 of which indicates the complete solidification of the cast strand 17. The solid phase content in the region of the sump 22 therefore increases from 0 to 100% according to the curve 24. The solid phase contents of 0%, 20%, 80% and 100% and the associated position of the strand cross-sections Q1, Q2, Q3 and Q4 are shown in FIG. 3.

Due to the external cooling of the cast strand 17, the surface temperature of the cast strand 17 extends along the curve 25 of FIG. 3. The core temperature is illustrated by the curve 26. It has been found that, in the region of the final solidification, the core temperature 26 drops much more quickly than the surface temperature 25. This temperature gradient can advantageously be used to define the longitudinal portion of the cast strand 17 that is advantageous for a soft reduction according to the system described herein. This is because the depth effect of the forming strokes of the forging tools 2, 3 depends, inter alia, on the temperature difference between the surface temperature 25 and the core temperature 26. By limiting this temperature difference 27 to a minimum that is still sufficiently effective for the depth effect, preferably 300 K, a longitudinal portion can thus be defined, outside of which a soft reduction is no longer useful. The strand cross-section in which the temperature difference 27 is 300 K is denoted Q5 in FIG. 3.

Since no forces that influence the core porosity can be exerted on the core via a reduction in cross-section in the case of a liquid core, a soft reduction of the cast strand 17 can only be carried out with a suitable solid phase content. In this context, the minimum solid phase content can be set at 80%. This means that, as shown in FIG. 3, a longitudinal portion 28 results for the advantageous soft reduction of the cast strand 17, namely between the strand cross-section Q3 having a solid phase content of 80% and a strand cross-section Q5 in which the temperature difference 27 between the surface temperature 25 and the core temperature 26 is 300 K.

The invention claimed is:

1. Method for machining a metal cast strand of round cross-section, comprising:

feeding the metal cast strand through a forging press; and reducing a cross-section in a final solidification region of the metal cast strand that is before and after complete solidification of the metal cast strand using at least three forging tools of the forging press to provide forming strokes distributed around a circumference of the metal cast strand and acting simultaneously on the metal cast strand wherein, with each of the forming strokes, the metal cast strand is formed by forging tools in a longitudinal portion that corresponds to at least one quarter of a diameter of the metal cast strand prior to a reduction in cross-section, and wherein, between the forming strokes, the forging tools are rotated through one angle step about the axis of the metal cast strand.

2. Method according to claim 1, wherein, with each forming stroke, the metal cast strand is formed by the forging tools in a circumferential region of at least 20°, divided among the individual forging tools and relating to the mean width of the contact areas between the forging tool and the metal cast strand.

3. Method according to claim 2, wherein the metal cast strand is machined by the forging tools in a longitudinal portion that extends from a cross-section of the metal cast strand with a solid phase content of 80% to a cross-section in which a temperature difference between a core and a surface of the metal cast strand is 300 K.

4. Method according to claim 3, wherein the cross-section of the metal cast strand is reduced by at least 8% by the forging tools.

5. Method according to claim 2, wherein the cross-section of the metal cast strand is reduced by at least 8% by the forging tools.

6. Method according to claim 1, wherein the metal cast strand is machined by the forging tools in a longitudinal portion that extends from a cross-section of the metal cast strand with a solid phase content of 80% to a cross-section in which a temperature difference between a core and a surface of the metal cast strand is 300 K.

7. Method according to claim 6, wherein the cross-section of the metal cast strand is reduced by at least 8% by the forging tools.

8. Method according to claim 1, wherein the cross-section of the metal cast strand is reduced by at least 8% by the forging tools.

9. Device for machining a metal cast strand of round cross-section by reducing the cross-section in the final solidification region, comprising:

a housing;

a frame of a forging press mounted in the housing;

at least three forging tools which are arranged in a rotationally symmetrical manner in relation to a forging axis, are mounted in the frame, and are connected to a drive to provide forming strokes radial to the forging axis, wherein the frame is mounted in the housing to be rotatable about the forging axis; and a stepper drive that is independent of the drive that provides the forming strokes and connected to the frame to rotate the frame through in each case one angle step between the forming strokes;

wherein the frame is mounted within the housing in an axially displaceable manner and is connected to an axial actuator.

* * * * *